US005254164A

United States Patent [19]

Masahumi

[11] Patent Number: 5,254,164

[45] Date of Patent: Oct. 19, 1993

[54] COATING SYSTEM INCLUDING INDEXING TURRET ROTATABLE IN THE VERTICAL AND HORIZONTAL PLANES ABOUT A STATIONARY SHAFT WITH LOADING AND UNLOADING OF CONTAINERS AND CLOSURES FROM THE EDGES OF THE TURRET

[75] Inventor: Matsunaga Masahumi, Yokohama, Japan

[73] Assignee: Nordson Corp., Westlake, Ohio

[21] Appl. No.: 898,651

[22] Filed: Jun. 15, 1992

[51] Int. Cl.[5] ..... B05B 1/00

[52] U.S. Cl. ..... 118/58; 118/319; 118/500; 118/642; 198/471.1; 414/223

[58] Field of Search ..... 118/319, 58, 500, 642; 198/471.1; 414/223; 427/425

[56] References Cited

U.S. PATENT DOCUMENTS

| | | | |
|---|---|---|---|
| 2,103,270 | 12/1937 | Murch | 118/319 |
| 3,026,989 | 3/1962 | Schaltegger | 198/471.1 |
| 3,498,260 | 3/1970 | De Jean | 118/319 |
| 3,776,420 | 12/1973 | Melind | 118/319 |
| 3,904,930 | 9/1975 | Waldron et al. . | |
| 4,025,664 | 5/1977 | Gerek et al. . | |
| 4,109,027 | 9/1978 | Crose . | |
| 4,158,071 | 6/1979 | Jordan et al. . | |
| 4,180,844 | 12/1979 | Peck . | |
| 4,830,169 | 5/1989 | Nariki | 118/319 |
| 4,987,001 | 1/1991 | Knobbe et al. . | |

OTHER PUBLICATIONS

"Training and Service Manual for Model #107 Can End Post-Repair Spray Machine" by H. L. Fisher Manufacturing Co., Inc. of Des Plaines, Ill.

*Primary Examiner*—W. Gary Jones
*Assistant Examiner*—John Hoffmann
*Attorney, Agent, or Firm*—Howard M. Cohn

[57] ABSTRACT

This invention relates to coating systems and to methods and apparatus for coating containers and closures employing container and closure indexing machines having vacuum chucks mounted on the edge of one or more turrets rotating in horizontal or vertical planes about a stationary shaft for loading, spray coating, optionally curing and unloading can and can ends secured to vacuum chucks extending radially from the edges of the turret. Further, devices are provided for loading and unloading cans and can lids onto and off of a turret rotating in either the horizontal or vertical plane.

14 Claims, 8 Drawing Sheets

COATING SYSTEM INCLUDING INDEXING TURRET ROTATABLE IN THE VERTICAL AND HORIZONTAL PLANES ABOUT A STATIONARY SHAFT WITH LOADING AND UNLOADING OF CONTAINERS AND CLOSURES FROM THE EDGES OF THE TURRET

FIELD OF THE INVENTION

This invention relates to coating systems, and more particularly to methods and apparatus for container and closure coating employing can and can end indexing machines having vacuum chucks mounted on a turret rotating in the horizontal or vertical planes about a stationary shaft for loading, spray coating, curing and unloading can and can ends secured to the edges of the turret.

BACKGROUND OF THE INVENTION

Can and can end indexing machines are well known in the art and a representative system is disclosed, for example in the Training and Service Manual for the Model No. 107 Can End post-Repair Spray Machine, manufactured and sold by the H. L. Fisher Manufacturing Co., Inc. of Des Plaines, Ill. As disclosed in the Training and Service Manual, the can end indexing machines are specifically designed to apply a protective spray coating on the product side of a tinplate or aluminum can end. Other relevant prior art is an alternative machine for indexing containers, i.e. cans, also manufactured and sold by the H L. Fisher Manufacturing Co., for indexing cans. This alternative machine, as illustrated in FIG. 11, is similar to the Model No. 107 machine except that the cans are vacuumed onto chucks which project outwardly from the face of the turret. A problem with these types of prior art can and can end indexing machines, such as the Model No. 170 machine, however, is that the rotating vacuum turret is designed for rotation only in a vertical plane which limits its versatility and usefulness in some manufacturing facilities where rotation in either the horizontal or vertical plane would be advantageous because of space considerations. Rotation in the horizontal plane is also advantageous because it facilitates easier loading and unloading of the cans. The Model No. 170 type machines do not show or suggest horizontal rotation because the feed and unloading assemblies require vertical orientation.

Another problem with the prior art systems was the inability to stack two or more vacuum turrets on a single indexing machine. Where several turrets are required, a separate indexing machine, along with its associated power lines, pressure lines and vacuum lines, is needed for each additional turret. Besides the additional expense of purchasing and installing a separate indexing machine for each turret, added floor space, machine operator time and maintenance are costly additions needed for operating each extra turret. The Model No. 170 type machines do not show or suggest stacking several turrets on a single machine.

Another problem with an indexing machine design having cans project outwardly from the face of the turret is that loading and unloading of the cans is somewhat difficult and awkward.

OBJECTS AND SUMMARY OF THE INVENTION

It is an object of the present invention to provide a coating system and method of operating the coating system including an indexing machine with vacuum chucks mounted on a turret rotating about a stationary shaft which obviates the problems and limitations of the prior art systems.

It is another object of the present invention to provide a coating system and method of operating the coating system wherein a coating system indexing machine has vacuum chucks mounted on a turret which rotate in the horizontal or vertical planes about a stationary shaft It is still another object of the present invention to provide a coating system and method of operating the coating system wherein a coating system indexing machine has vacuum chucks mounted on the edge of a rotating turret onto which can or can ends are loaded.

It is yet another object of the present invention to provide a coating system and method of operating the coating system wherein a coating system indexing machine has a plurality of turrets with vacuum chucks mounted thereon for rotation in either the vertical or horizontal plane about a single stationary shaft.

It is another object of the present invention to provide a coating system and method of operating the coating system wherein a coating system indexing machine having a turret which rotates in the horizontal or vertical planes is provided with apparatus for loading and unloading can ends on and off from the edge of the turret.

It is still another object of the present invention to provide a coating system and method of operating the coating system wherein a coating system indexing machine having a turret which rotates in either the horizontal or vertical planes is provided with apparatus for loading and unloading cans from vacuum chucks extending radially outward from the edge of the turret.

In accordance with the invention, a coating system indexing machine comprises a central, stationary shaft having first and second bores adapted for connection to a source of vacuum air pressure and to a source of positive air pressure, respectively At least one turret is rotatably disposed about the stationary shaft for indexing therearound. The turret has passageway means for selective communication with the first and second bores.

Also in accordance with the invention, the indexing machine has at least two turrets disposed about the stationary shaft. Further, the one or more turrets can rotate in either the vertical or horizontal planes.

Further in accordance with the invention, an indexing machine for cans or can ends to be coated has at least one turret with multiple vacuum chucks rotating in a horizontal or vertical plane. Means load the cans or can ends onto one of the vacuum chucks at a first station of the turret. Then, means apply a coating to the can or can ends at a second station of the turret. Next, means cure the coating on the can or can end at a third station of the turret. Finally, means unload the can or can ends from a fourth station of the turret. In accordance with the invention. The cans or can ends can alternatively be unloaded at the third station of the turret and subsequently cured Also in accordance with the invention, a gravity feed device sequentially loads a plurality of cans to be coated onto a turret with a plurality of vacuum chucks extending therefrom and rotating in either the horizontal or vertical plane. The gravity feed device includes means for positioning one of the cans adjacent to one of the plurality of vacuum chucks and means for feeding the plurality of cans under the influence of gravity to the means for positioning one of the cans.

Moreover, in accordance with the invention, a feeder device for loading can lids to be coated onto a turret having a plurality of vacuum chucks rotating in either the horizontal or vertical plane comprises a tube having one end disposed adjacent to the turret. A screw element disposed within the tube is adapted to receive the can lids. Means to rotates the screw element advances each can lid to a position where it can be vacuumed onto the vacuum chuck.

Further, in accordance with the invention, an unloading device for unloading lids which have been coated from a turret rotating in either the horizontal or vertical plane comprises a Vacuum chuck disposed on a turret rotating in either the horizontal or vertical plane. Means grip the edges of a coated lid secured by a vacuum pressure at the vacuum chuck. Means then disconnect the vacuum at the vacuum chuck and means direct low pressure air at the lid to release it away from the vacuum chuck while the means for gripping the edges of lid transfers the lid to a location away from the turret for curing of the coating.

Also in accordance with the invention, a method of coating products, such as containers or closures of containers, comprises the following steps. The products are indexed in a horizontal plane by an indexing machine having at least one turret with plural vacuum chucks extending from the edge of the turret, with the turret rotating about a fixed vertical shaft. Products to be coated are loaded onto the vacuum chucks at a first station. A coating material is then sprayed onto the product at a second station of the turret. Next, the coated products are unloaded from the vacuum chucks at a third station.

Further in accordance with the invention, a method of coating containers comprises the following steps. Containers are indexed in a vertical plane by means of an indexing machine having a turret which indexes around a fixed horizontal shaft through at least three stations comprising a first station, a second station and a third station. The indexing machine has a plurality of Vacuum chucks which extend from the edge of the turret in a radial direction relative to the shaft. The containers are loaded onto the vacuum chuck at the first station. Then, a coating material onto is sprayed onto the containers at the second station. Next, the coated containers are unloaded from the vacuum chucks at the third station.

Moreover in accordance with the invention a method of coating products, such as containers or closures of containers, carried on an indexing machine comprises the following steps. At least first and second turrets are rotated around a common fixed shaft through at least three stations comprising a first station, a second station and a third station. Each of the turrets has a plurality of products supporting chucks extending in a radial direction away from the shaft The products to be coated are simultaneously loaded onto the vacuum chucks of the first and second turrets at the first station. The products carried on the chucks of the first and second turrets are simultaneously coated at the second station of the turret. Then the coated products are unloaded from the vacuum chucks at a third station.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
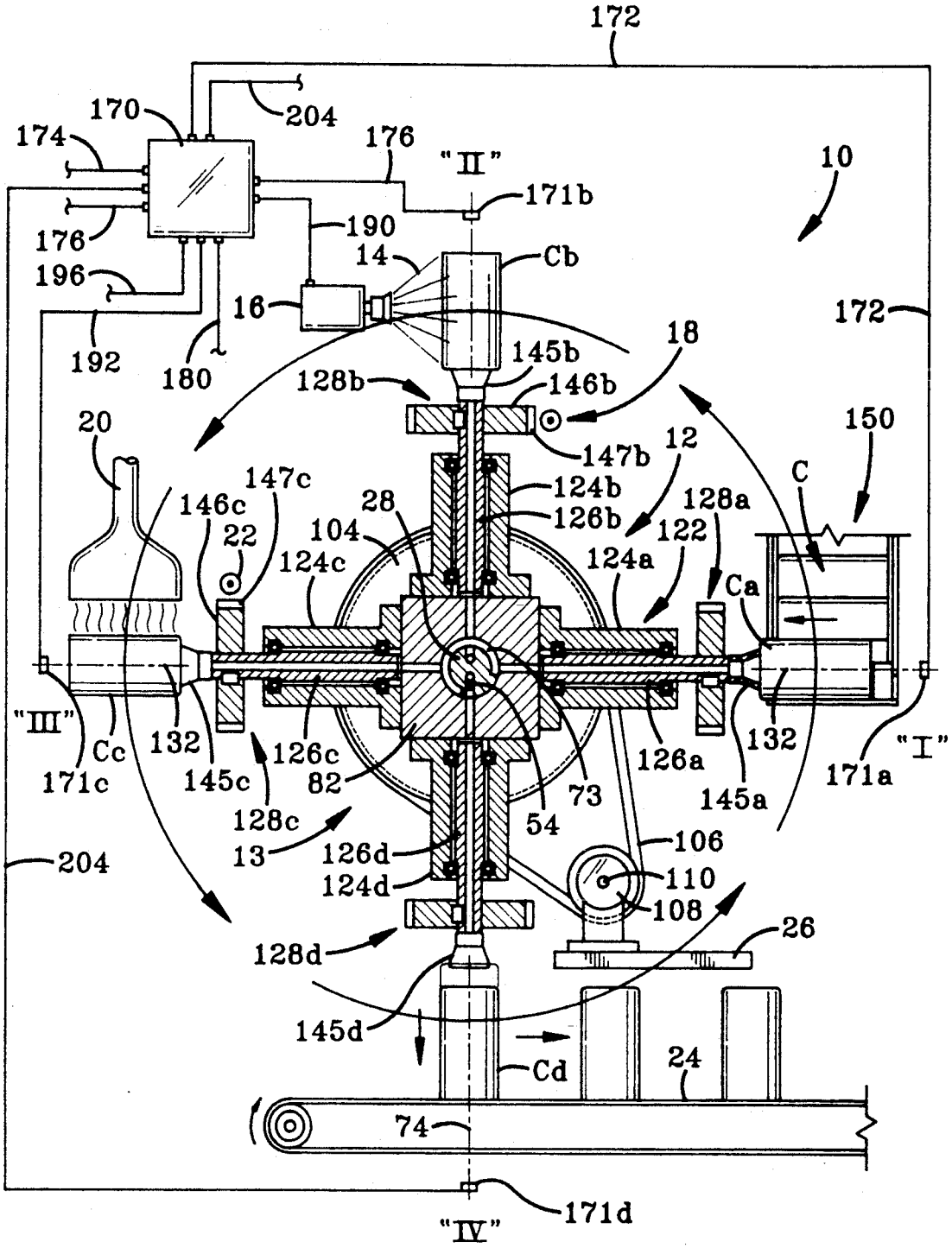
FIG. 1 shows a front elevational view, in cross section, of a turret-type, indexing coating system incorporating the present invention.

Referring to FIG. 1, a can and can end coating system 10 is illustrated. The can and can end coating system 10 includes an indexing turret-type machine 12 having at least one indexing turret 13. Containers and closures, such as cans C and can ends as described hereinafter), are individually loaded onto turret 13. At each station "I", "II", "III" and "IV", the can and can ends are designated With a subscript a, b, c and d, respectively. Can $C_a$ is initially loaded onto turret 13 at station "I". The turret 13 is then indexed ninety degrees, counter-clockwise to station "II" where can $C_b$ is sprayed with a coating material 14 by a spray gun 16. Simultaneously, can $C_b$ is rotated by a pulse of air from an air nozzle 18 acting on a finned or gear plate **146*b* to insure even coating of the surface being sprayed. Turret 13** is again indexed 90 degrees, counter-clockwise, to station "III"

where the now coated can $C_c$ is located adjacent to a curing oven 20 which cures the coating, i.e. dries it into a solid, continuous coating, while can $C_c$ is rotated by an air nozzle 22. Finally, the turret 13 is indexed ninety degrees in the counter-clockwise direction to station "IV" where can $C_d$, with a cured coating, is unloaded from turret 13 onto a conveyor 24 for delivery to the next processing location (not shown).

Figure 1A:
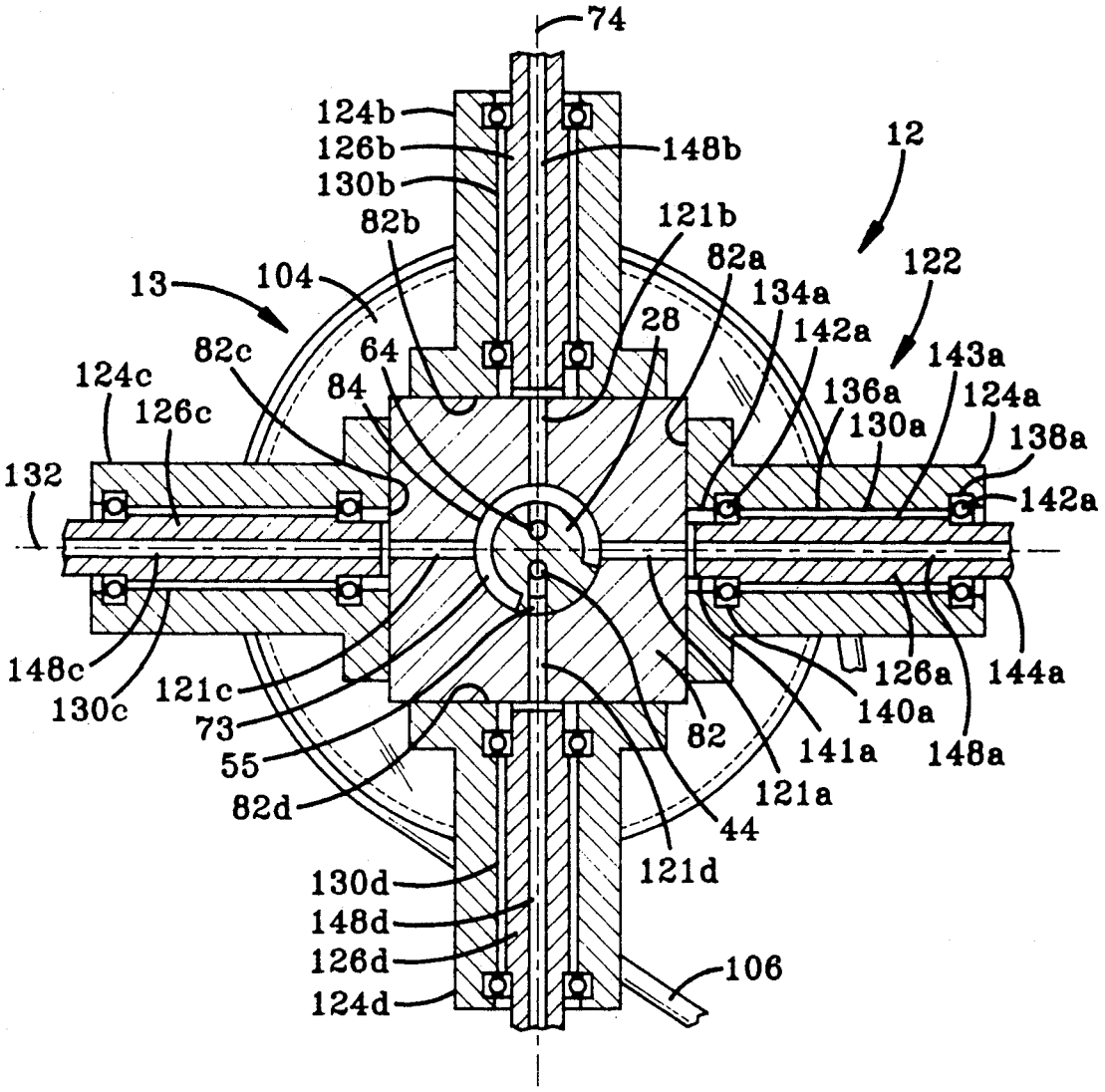
FIG. 1A shows an enlarged front elevational view, in cross section, of a portion of FIG. 1 showing a turret disposed on a stationary shaft incorporating the present invention.
Figure 2:
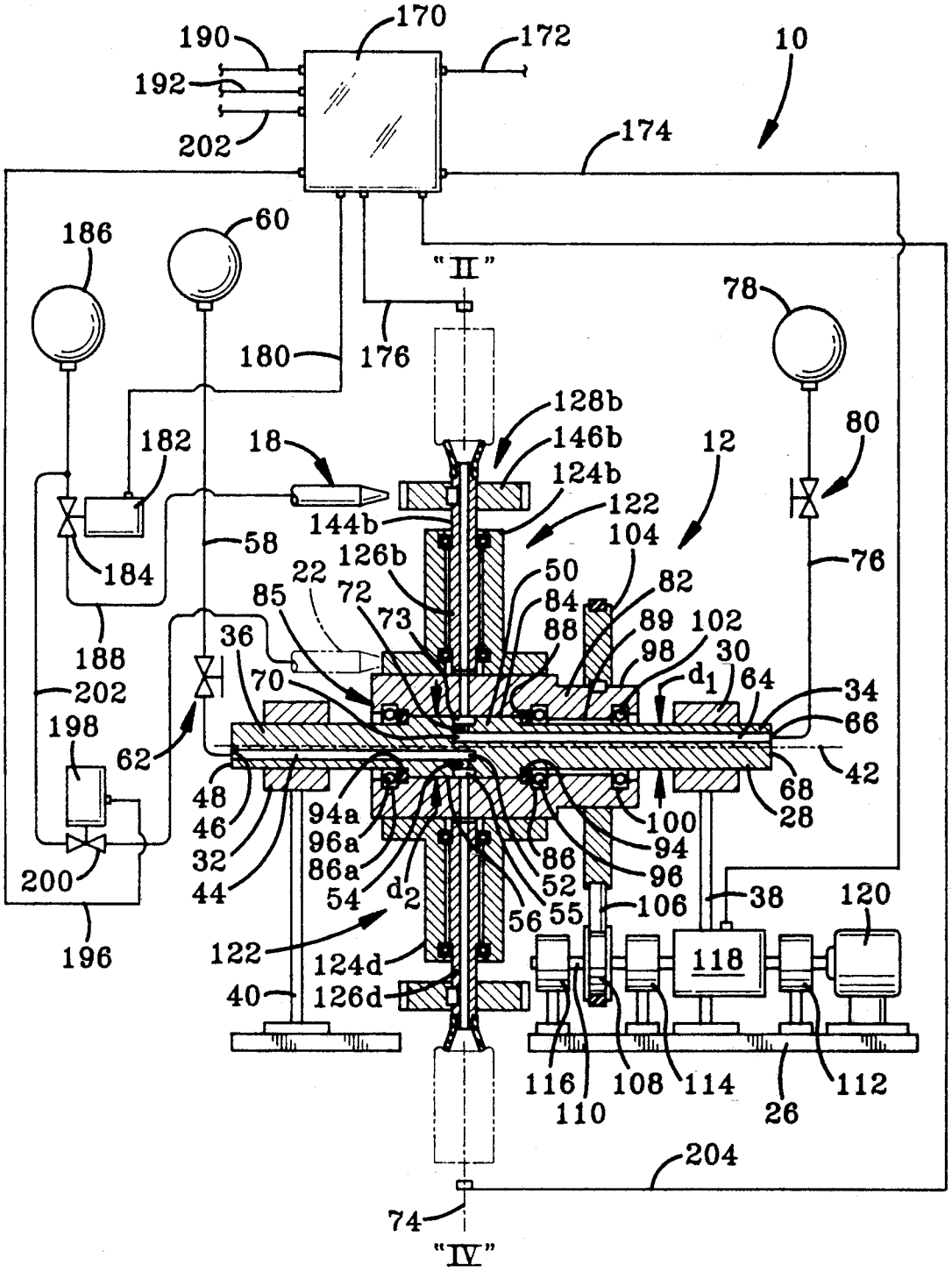
FIG. 2 shows a side elevational view, in cross section, of the indexing machine in FIG. 1.

Referring to FIGS. 1, 1A & 2, an embodiment of a turret-type indexing machine 12 supported on a base plate 26 is illustrated. Machine 12 includes at least one turret 13 which rotates in a vertical plane about a stationary, central shaft 28. Shaft 28 has opposite end sections 34 and 36 of a first diameter $d_1$ and a central section 50 with a second diameter $d_2$, wherein $d_2$ is slightly larger than $d_1$. Stationary shaft 28 is securely mounted within clamp members 30 and 32 which are disposed about opposite end sections 34 and 36 of the shaft. The clamp members 30 and 32 are affixed to support legs 38 and 40, respectively, which in turn are secured by conventional means such as bolts to base plate 26, so that a longitudinally extending centerline 42 through shaft 28 is located substantially parallel to the base plate 26.

Shaft 28 has a first elongated, longitudinal bore 44 with a first end 46 opening at one outer end 48 of shaft 28. Bore 44 extends from shaft outer end 48 to the approximate center of central section 50 of shaft 28 and has an interior end 52 opening to a radially outwardly, extending passageway 54 which connects to an outlet passageway 55 opening to the outer circumferential surface 56 of the central section 50 of shaft 28. The first end 46 of bore 44 is connected by a hose 58 (shown in phantom) to a source 60 of positive air pressure. A shutoff valve 62 (either manually or automatically controlled) regulates the pressurized air flow through hose 58 to the bore 44, as discussed hereinafter.

Shaft 28 has a second elongated, longitudinally extending bore 64 with an opening 66 at the opposite outer end 68 of shaft 28. Bore 64 extends from shaft outer end 68 to the approximate center of central section 50 and is parallel to and offset from the bore 44 Bore 64 has an inner end 70 opening to a radially outwardly extending passageway 72 Which connects to a groove 73 that extends for about 260 degrees around the outer circumferential surface 56 of the central section 50 of shaft 28. Outlet passageway 55 is located about ten degrees counter-clockwise from one end of groove 73. The radially outwardly extending passageways 54 and 72 are in the same plane as a transverse centerline 74 which crosses centerline 42 and is perpendicular thereto. The opening 66 of bore 64 is connected by a hose 76 (shown in phantom) to a source 78 of vacuum air pressure. A shutoff Valve 80 (either manually or automatically controlled) regulates the vacuum pressurize in hose 76, as discussed hereinafter.

Referring again to FIGS. 1, 1A & 2, turret 13 includes a substantially square shaped, turret block 82 having a bore 84 extending therethrough. Turret block 82 rotates about centerline 42 with the central section 50 of stationary shaft 28 positioned within the bore 84. Bearing means 85 are provided between the shaft 28 and turret block 82 of turret 13. Bearing means 85 includes first and second stepped grooves 86 and **86*a* in the wall 89 of bore 84. Each of the grooves 86 and 86*a* is located at the intersection of the end sections 34 and 36, respectively, and the central section 50. Seal elements 94 and 94*a* are disposed in the grooves 86 and 86*a* at the intersections of the end sections 34 and 36, respectively, and the central section 50 to prevent air leakage from the groove 73 or the outlet passageway 55 along the space between the interior bore wall 89 and the shaft 28. Bearing elements 96 and 96*a* are disposed in the grooves 86 and 86*a*. respectively, to reduce the friction from the rotation of turret block 82 around shaft 28**

The turret block 82 has a drive end section 98 projecting longitudinally outward from one end of the turret block. End section 98 has the bore 84 extending therethrough and a groove 100 disposed in the wall 89 of bore 84. A bearing element 102 is disposed in the groove 100 to enable low frictional rotation of the end section 98 of turret block 82 around the shaft 28. A cylindrical pulley or gear 104 is fixedly secured to drive end section 98. The pulley 104 is rotated by a drive train mechanism including a drive belt or chain 106 disposed about the outer circumferential surface of the pulley and the outer circumferential surface of a drive pulley 108 which in turn is secured to and rotated by a drive shaft 110. The drive shaft 110 is supported by support bearing members 112, 114 and 116, which in turn are attached to base plate 26 A rotational speed control device 118, connected to the shaft 110, regulates the speed of rotation of drive pulley 108 while a motor 120 turns the shaft 110.

The turret block 82, as seen in FIG. 1A, has passageways **121*a*, 121*b*, 121*c* and 121*d* between the bore 84 and the outwardly facing surfaces 82*a*, 82*b*, 82*c* and 82*d*, respectively, of turret block 82. Passageways 121*a*–121*d* are disposed at ninety degree angles with respect to one another and are positioned for selective communication with the passageway 55 and groove 73**, as discussed hereinafter.

Turret 13 also includes vacuum chuck support means 122 which includes vacuum chuck support members **124*a*, 124*b*, 124*c*, and 124*d*, vacuum chucks 126*a*, 126*b*, 126*c* and 126*d* and means 128*a*, 128*b*, 128*c* and 128*d* for rotating the vacuum chucks 126*a*, 126*b*, 126*c* and 126*d***, respectively.

The vacuum chuck support members **124*a*, 124*b*, 124*c*, and 124*d* are securely attached to surfaces 82*a*, 82*b*, 82*c* and 82*d*, respectively, of turret block 82. Each vacuum chuck support member 124*a*–124*d* extends radially outwardly from the respective turret face to which it is secured. Support members 124*a* and 124*c* have bores 130*a* and 130*c* extending therethrough which are concentric, in opposite directions, along a centerline 132. As seen in FIGS. 1 and 1A, centerline 132 crosses through the crossing point of centerlines 42 and 74 and is perpendicular to a plane through centerlines 42 and 74, illustrated in FIG. 2. The support members 124*b* and 124*d* extend outwardly from turret block 82, in opposite directions, along centerline 74 and have bores 130*b* and 130*d* extending therethrough which are concentric, in opposite directions, along centerline 74. Each of the vacuum chuck support members, as well as its associated vacuum chuck and means for rotating the vacuum chuck are essentially identical and therefore the details of only chuck support member 124*a*, its associated vacuum chuck 126*a* and means 128*a* for rotating chuck 126*a*, that is, the designation of the these elements at station "I", are now described. It is understood, that as the turret 13 is indexed around shaft 28**, each of the vacuum chucks and there associated components change their designation from numerals followed by "a" to identical numerals followed by "b", "c" and "d".

Bore **130*a* in support member 124*a* has a first elongated section 134*a* and a second elongated section 136*a***.

Second elongated section 136a is substantially longer than the first elongated section 134a. Two cylindrical grooves 138a and 140a are provided in bore 130a to receive bearings 142a. Groove 138a is located at the outer, unsupported end of support member 124a, while groove 140a is disposed at the intersection of elongated sections 134a and 136a. Bearing elements 138a, disposed in grooves 138a and 140a, provide low friction rotation of vacuum chuck 126a within the bore 130a, as discussed hereinafter.

Vacuum chuck 126a is cylindrically shaped and has a first elongated section 141a having a first diameter which is disposed in the bore 130a opposite first elongated section 134a of the chuck support member 122a, a second elongated section 143a having a second diameter greater then the first diameter of first section 141a which is disposed in the bore 130a through second elongated section 136a and a third elongated section 144a which has substantially the same diameter as first section 141a and projects outwardly from an opening of bore 130a at the end of the support member 122a. The vacuum chuck 126a is rotatably secured in bore 130a with a bearing elements 140a disposed at the intersection of the first and second elongated sections 141a, 143a and a bearing element 138a disposed at the intersection of the second and third elongated sections 143a and 144a.

Bores 148a, 148b, 148c and 148d extend through vacuum chucks 126a–126d, respectively, for communication with bore 121a in turret block 82, and in some circumstances as illustrated in FIG. 2 and discussed hereinafter, with the groove 73 and bore 64. At the outlet end of vacuum chucks 126a–126d are conventional, outwardly flared, flexible vacuum chuckheads 145a, 145b, 145c and 145d, respectively. The vacuum chuckheads 145a–145d have an open interior which communicates with the bore 148a–148d in the vacuum chucks and passageways of the turret 13 disposed in the turret block for tight sealing engagement against a can $C_a$ or can end so as to securely hold the can or can end by vacuum as it is indexed around the turret 13.

The turret 13 also has means 128a, 128b, 128c and 128d for rotating the vacuum chucks 126a, 126b, 126c and 126d, respectively Which are substantially identical and. accordingly, only means 128b and 128c are discussed herein. Means 128b includes a cylindrical plate 146b with fins or gear teeth 147b disposed about its cylindrical edge surface. Plate 146b is secured to the third elongated section 144b of the vacuum chuck 126b. At station "II", an air nozzle 18 directs a stream of air at fins or gear teeth 147b to spin the plate 146b and the vacuum chuck 126b so that a can $C_b$ is rotated while being sprayed with a coating by a spray gun 16. At station "III", an air nozzle 22 directs a stream of air at fins or gear teeth 147c to spin the plate 146c and the vacuum chuck 126c so that a can $C_c$, which has already been sprayed, is rotated in front of the curing element 20 so that the coating cures evenly on can $C_c$.

Figure 3A:
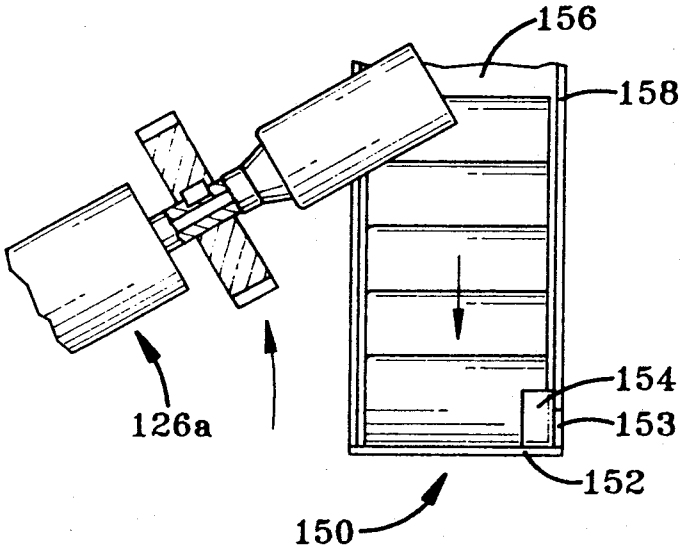
FIG. 3A is a schematic view illustrating the offset position of the gravity trough of FIG. 3 With relation to the vacuum chuck which is indexing between station "I" and station "II".
Figure 4:
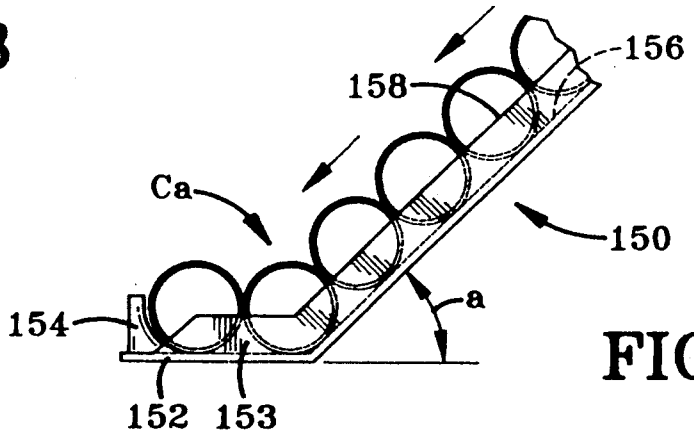
FIG. 4 is an elevational view taken along lines 4—4 of FIG. 3.
Figure 3:
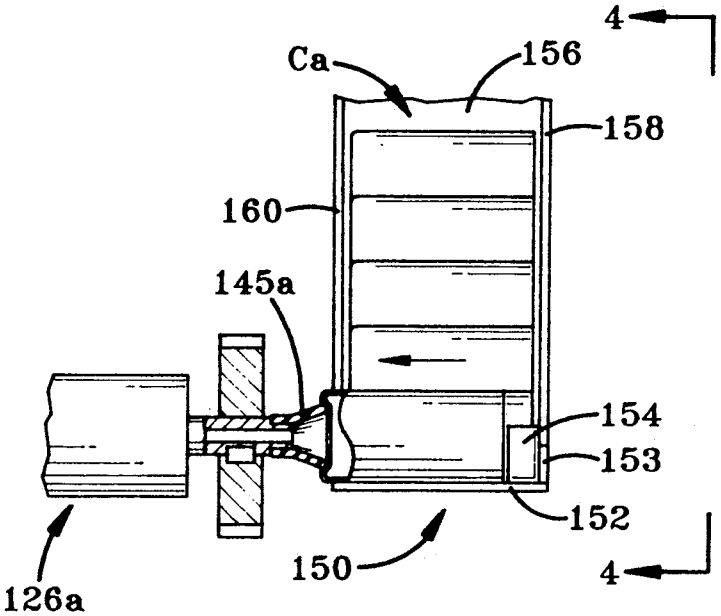
FIG. 3 is a schematic view of cans to be coated which are positioned in a gravity trough for pickup by the vacuum chuck of the indexing machine at station "I" in FIG. 1.

Referring to FIGS. 3, 3A and 4, there is illustrated a gravity feed trough or device 150 for container loading of the vacuum connector or chuckhead 145a at the free end of vacuum chuck 126a at station "I". The gravity feed device 150 is partially illustrated in FIG. 1. The gravity feed device 150 includes a delivery platform 152 which is disposed substantially parallel to the base plate 26. A side rail 153 maintains the alignment of the cans $C_a$ and a stop 154 properly positions each can, which rolls down an inclined delivery plate 156 under the influence of gravity, for being picked up by vacuum chuck 126a at station "I". Inclined delivery plate 156 is affixed at one end to delivery platform 152 and extends upwardly at an angle "a" of about 45 degrees to insure the positive and speedy feeding of cans to the platform 152. Upwardly extending side rails 158 and 160 are affixed to opposite longitudinal edges of delivery plate 156. The side rails 158 and 160 are separated by a predetermined distance to prevent twisting of the cans as they roll down the delivery plate. As illustrated in FIG. 3A, the vacuum chuck 126A is offset from the gravity trough 150 so that it does not interfere with the can $C_a$ being indexed counter-clockwise to station "II" after being vacuumed onto the chuckhead 145a, as will be later described.

A system controller 170, as seen in FIGS. 1 and 2, controls the various components of the coating system 10 to insure that the cans are indexed to their proper position at precisely the right time so that the coated cans and can lids coated by system 10 are uniform in quality and do not require constant attention of a machine operator.

Referring to FIG. 1, there is illustrated a block diagram of the index system controller 170. Typically, the entire system controller will be provided on a single board. In response to a signal from a position indicator 171a, a control signal is sent through line 172 from station "I" to controller 170 indicating that a can $C_a$ is loaded onto the vacuum chuck 126a. Then, controller 170 sends a signal through line 174 to motor controller 118 for rotating drive shaft 110 and drive pulley 104 through drive belt 106 which in turn rotates turret block 82. This rotation indexes the vacuum chucks ninety degrees between stations, such as from station "I" to station "II". Once the can $C_b$ has arrived at station "II", a position indicator 171b sends a signal through line 176 to controller 170. In response thereto, a signal from controller 170 is sent through line 180 to a valve controller 182 to open valve 184 and allow pressurized air from a high pressure air source 186 to flow through pressure line 188 and nozzle 18 so as to impinge on the fins or gear teeth 147b and rotate gear 146b which in turn rotates the vacuum chuck 126b and can $C_b$. Simultaneously, a signal is sent from controller 170 through line 190 to activate spray gun 16 and spray coating material 14 onto the rotating can $C_b$. After a preset amount of time, turret 13 is indexed another ninety degrees and a signal is sent through line 192 from position indicator 171c indicating the arrival of can $C_c$ at station Ill , where the can is cured by a curing oven 20. To provide even heating of the coating, a signal is sent via line 196 to a valve controller 198 to open valve 200 and allow pressurized air from pressurized air source 186 to flow through pressure line 202 and nozzle 22 so as to impinge on the fins and gear teeth 147c and rotate gear 146c which in turn rotates the Vacuum chuck 126c and can $C_c$ within or adjacent oven 20. Finally, when can $C_d$ reaches station "IV", a signal is sent from position indicator 171d through line 204 to controller 170. In response to this latter signal, the controller 170 drops the can $C_d$ onto the conveyor 24 as will later be described in more detail, and begins the cycle again. In operation, the indexing machine 12 indexes a can to each station "I"–"IV", simultaneously. In the event that a can does not arrive at one of the stations, and position indicators 171a–171d do not send an arrival signal to controller 170, a device (not shown) can be operated by controller 170 to either activate a warning signal to alert the machine operator and/or shut the machine 12 off.

In operation of the first embodiment, cans $C_a$ are advanced down a delivery plate 156 of a gravity trough 150 and onto a delivery platform 152 until encountering a stop 154. A position sensor 171*a* signals its arrival to controller 170 and can $C_a$ is then vacuumed onto vacuum chuckhead 145*a* of vacuum chuck 126*a* by a vacuum applied from a Vacuum source 78, through bore 64 of shaft 42, groove 73, passageway 121*a* in turret block 82 and bore 148*a* in vacuum chuck 126*a*. Turret 13 is then indexed in a counterclockwise direction ninety degrees until the can reaches station "II" where it is coated with liquid or powder coating material 14 by spray gun 16. Note that spray gun 16 would be disposed out of the path of the can so that the can $C_b$ can index from station "II" to station "III". A position sensor 171*b* at station "II" indicates the presence of can $C_b$ and sends a signal through line 176 to controller 170 which in turn sends a signal through line 190 to activate spray gun 16 for a preset amount of time. Concurrently therewith, a signal is sent from controller 170 through line 180 to open valve 184 and direct a stream of pressurized air from nozzle 18 against fins or gear teeth 147*b* to rotate vacuum chuck 126*b* and insure that an even layer of coating material is applied to can $C_b$. Note that while the exterior of the can is shown being coated in FIG. 1, alternatively all or a portion of the interior of the can could be coated by one or more spray guns at station "II".

After a predetermined time period, turret 13 rotates another ninety degrees so that can $C_c$ is disposed adjacent curing oven 20 at station "III". A position sensor 171*c* at station "III" indicates the presence of can $C_c$ and sends a signal through line 192 to controller 170. Controller 170 then sends a signal trough line 196 to valve controller 198 which in turn opens valve 200 and directs a stream of pressurized air from external high pressure source 186 through nozzle 22 against fins or gear teeth 147*c* to rotate the vacuum chuck 126*c* and evenly cure the coating on can C. Then, after another predetermined time period, turret device 13 rotates another ninety degrees so that can $C_d$ is disposed above conveyor 24 at station "IV". A position sensor 171*d*, which would be positioned at some place sufficiently proximate to the can, indicates the presence of can $C_d$ and sends a signal through line 204 to controller 170. Upon reaching station "IV", passageway 55 in central shaft 28 is aligned with passage 121*d* in turret block 82. A stream of pressurized air would pass from source 60, through valve 62 which would preferably be opened automatically by controller 170 in response to sensor 171*d*, through bore 44 and passage 148*d* to release or blow can $C_d$ from the end of vacuum chuck 126*d* and onto the conveyor belt 24 Then, the turret 13 is indexed counterclockwise again and the process repeats itself.

Figure 5:
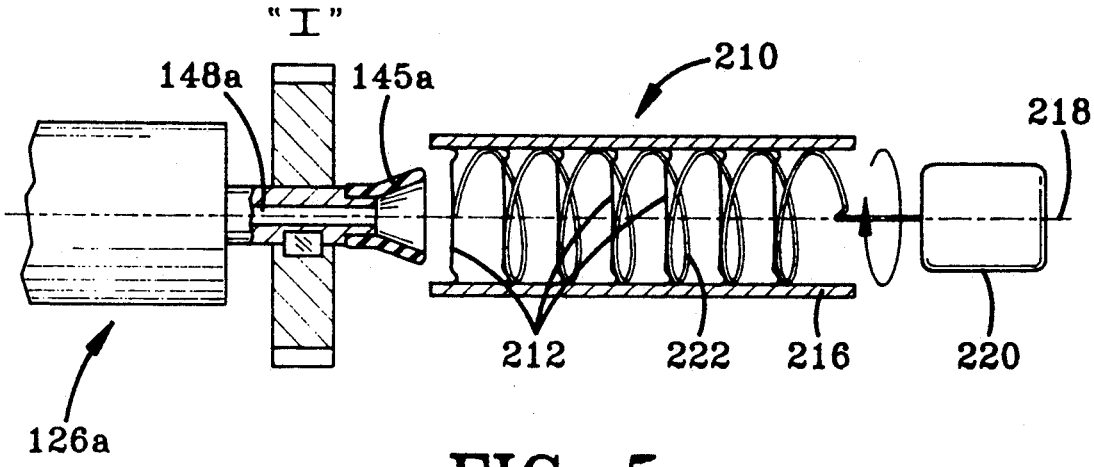
FIG. 5 is an enlarged fragmentary, cross-sectional, plan view of a screw-type conveyor at station "I" of a modified version of the indexing machine in FIG. 1 for positioning can ends onto a vacuum chuck.

While the invention has been described with reference to a machine for indexing cans C or other containers such as oil filters, for example, it is also within the scope of the invention to substitute can ends 212 or other closures. Indexing turret machine 12, as illustrated in FIGS. 1, 1A and 2, can process can ends 212 with a few modifications. First, a can end feeder device 210, as illustrated in FIG. 5, is needed to load the can ends 212 onto the turret. The illustrated can end feeder device 210 is a screw-type conveyor which is disposed at station "I" of a modified version of the indexing machine 12, now adapted for coating can ends 212. Screw type conveyor 210 is positioned opposite vacuum chuck 126*a* which is substantially identical to the vacuum chuck 126*a* of FIG. 1. Vacuum pressure applied through bore 148*a* pulls the lid 212, from conveyor 210, against the end of vacuum chuckhead 145*a*. The screw type conveyor 210 includes a tube 216 concentrically disposed about a longitudinal axis 218 extending through the vacuum chuck 126*a*. A screw element 222, typically an opened center, spring-like element having a plurality of coils is disposed within tube 216. Can ends 212 are inserted by an automatic feed mechanism (not shown) between adjacent coils. An indexing motor 220, operatively controlled by a controller such as controller 170 by signals delivered through a control line (not shown) rotates the screw element 222 at the appropriate time just enough to advance the next can end 212 to a position where it can be vacuumed onto the chuckhead 145*a*.

Figure 6:
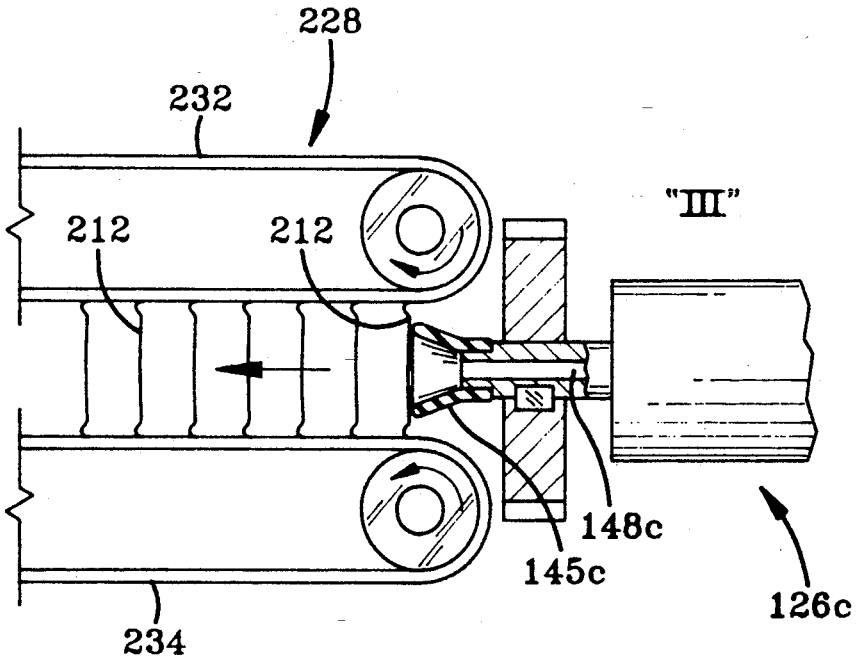
FIG. 6 is an enlarged fragmentary, cross-sectional, plan view of opposed conveyor belts, at station "III" of the modified version of the FIG. 1 indexing machine, for transferring coated can ends through a curing oven.
Figure 10:
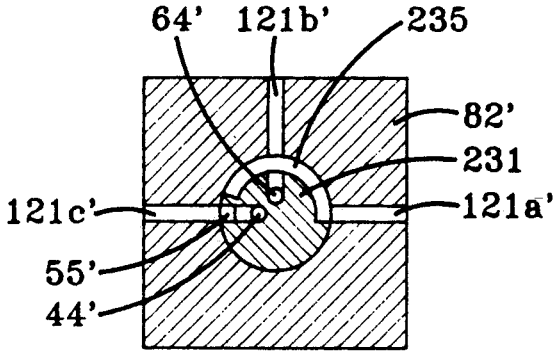
FIG. 10 is an enlarged fragmentary, cross-sectional, front elevational view of a central shaft for an alternative embodiment of the fixed shaft and turret block for a three station indexing machine.
Figure 11:
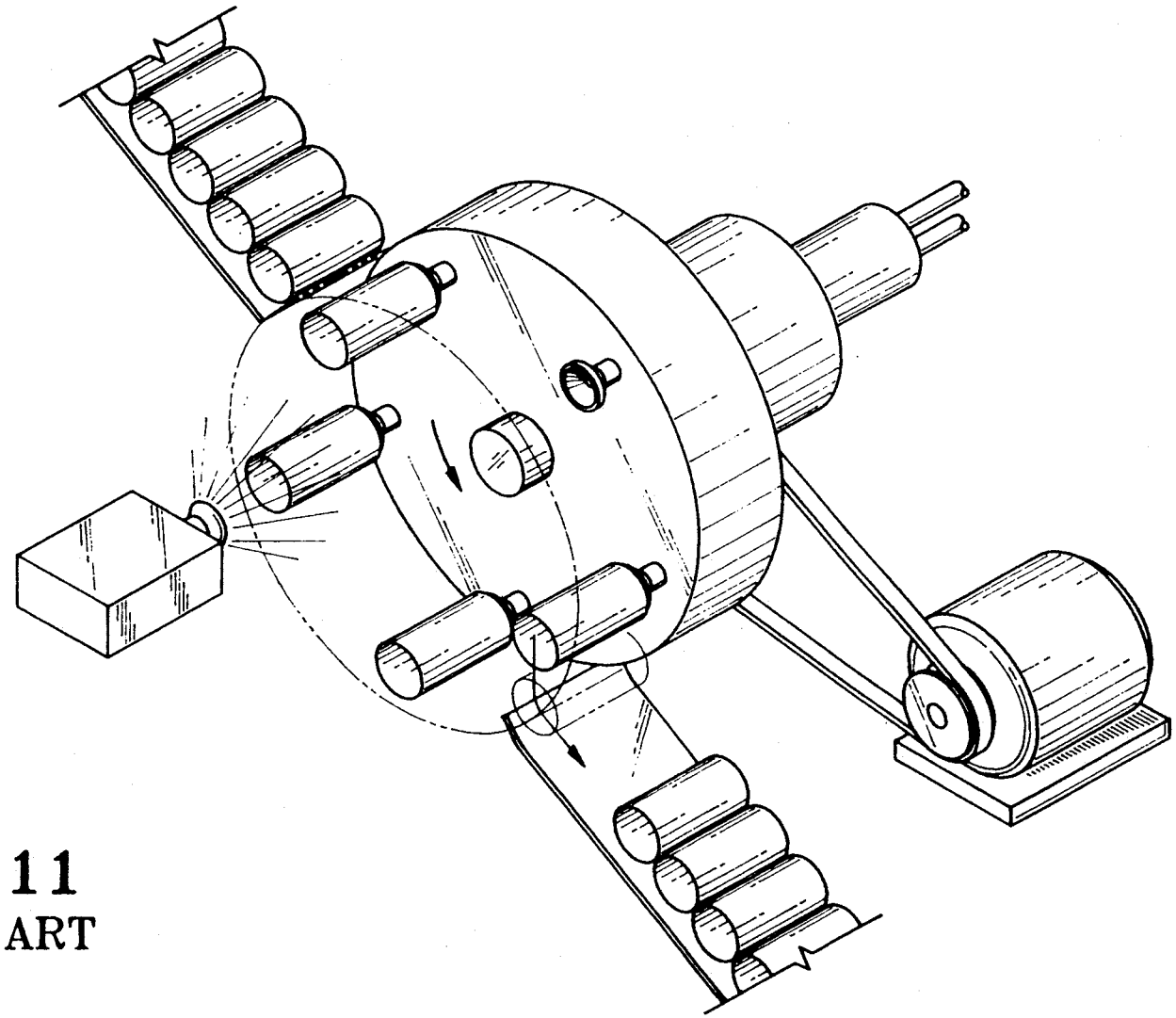
FIG-11 PRIOR ART
FIG. 11 is a side elevational view of a prior art, turret-type indexing machine.

Next the can end 212 is indexed to station "II", as in the embodiment of FIGS. 1, 1A and 2, and spray coated. As previously described, the vacuum chuck 126*b* can be rotated to insure even coating of can end 212. Then, the can end is indexed to Station "III" where the can end is removed from vacuum chuckhead 145*c* by the unloading device 228 shown in FIG. 6. Blow off passage 148*c* is provided in the vacuum chuck 126*c*. Blow off passage 148*c* is operationally similar to the blow off passage 148*d* in FIGS. 1 and 1A. A modified shaft 231, illustrated in FIG. 10 and described below, provides pressurized air at station "III", instead of station "IV" as in the embodiment illustrated in FIG. 1, to release the can lid 212 from vacuum chuck 126*c*, after the lid 212 has been indexed down between conveyor belts 232,234 of unloading device 228 so that the opposite sides of the edge of the lid 212 are in gripping engagement by opposed conveyor belts 232 and 234 having longitudinal extending, parallel surfaces which are spaced apart a predetermined distance to grip and transfer the coated lids through a curing oven (not shown). Shaft 231 has a groove 232 which extends for about 150 degrees around the outer cylindrical surface of the shaft. Throughout the specification, where elements are substantially identical, prime numbers are used to indicate like elements having unprimed numbers. Bore 64' is connected by a passageway to groove 235 and provides a vacuum pressure from external source 78 as previously discussed An outlet passageway 55' is located about ten degrees counter-clockwise from one end of groove 235 and is connected to a source 60 of positive air pressure through bore 44', as previously explained.

While turret 12 is shown rotating in a vertical plane in FIGS. 1, 1A and 2, it could also be rotated in a horizontal plane, not shown. When can lids are indexed in a horizontal plane, the can lid loaders and unloaders shown in FIGS. 5 and 6 can be used in the same fashion in which they are used when can lids are indexed in the vertical plane. Likewise, when cans are being indexed in a horizontal plane, the gravity trough 150 shown in FIGS. 3 and 4 could still be used to load the cans onto vacuum chuck 126*a*. In this case, trough 150 would be positioned so that when a can is vacuumed onto the chuck, as previously discussed, it is pulled past the stop 153 which extends vertically up from the end of the trough at the rear of the can (see FIG. 3) and is then rotated away from trough 150 towards station "II".

Figure 8:
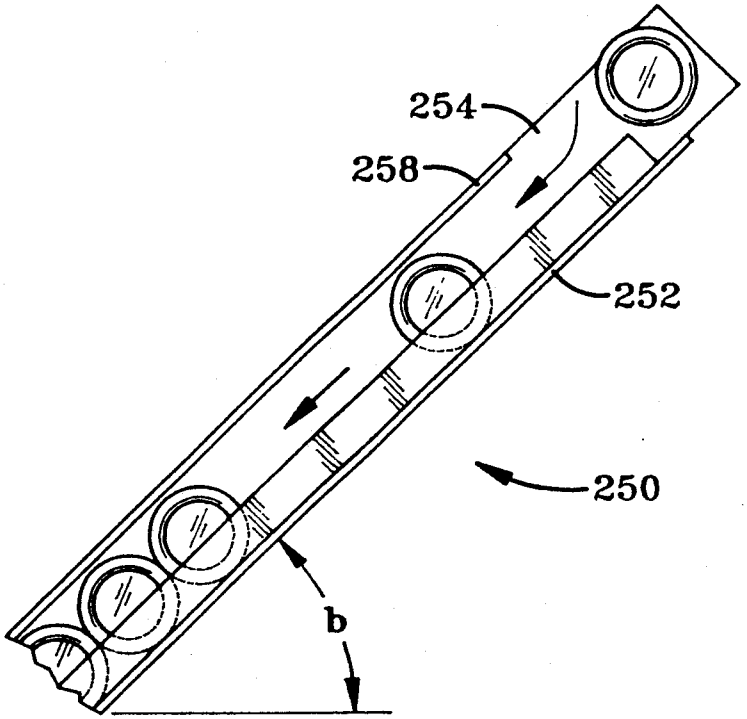
FIG. 8 is an elevational view taken along lines 8—8 of FIG. 7.
Figure 7:
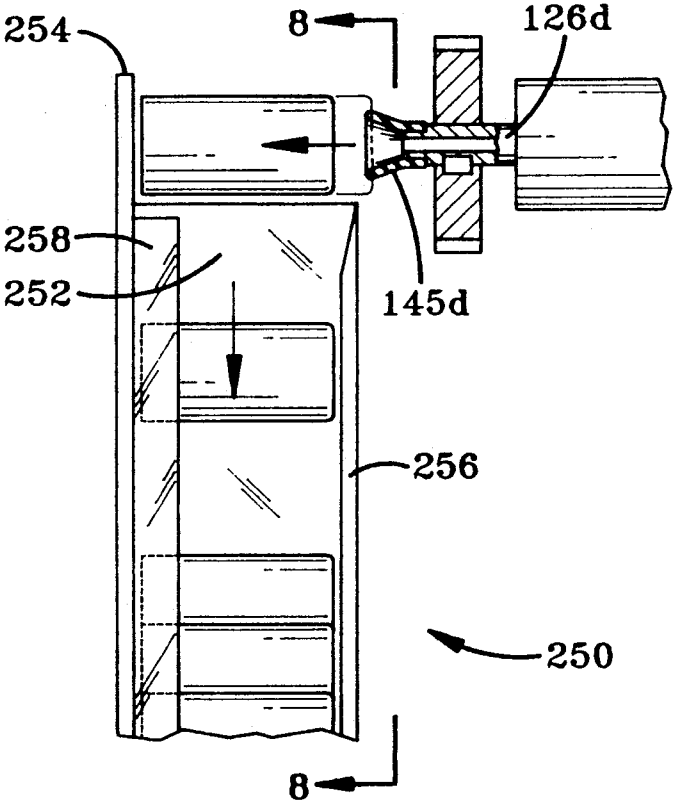
FIG. 7 is a schematic view of a gravity trough to unload cans at station "IV" of the indexing machine shown in FIG. 1 when modified to rotate in the horizontal plane.

However, with a turret rotating cans in a horizontal plane, after the cans are coated at station "II", and cured at station "III", a modified unloading system, such as a second gravity trough 250, as illustrated in FIGS. 7 and 8, would replace the conveyor 24 illustrated in FIG. 1. Gravity trough 250 is constructed of an unloading platform 252 which is disposed at an angle "b" of about 45 degrees. Gravity trough 250 includes side rails 254 and 256 affixed to opposite longitudinal edges of unloading platform 252 to guide the cans as they roll down the unloading platform under the influence of gravity. A narrow, elongated guide plate 258 is secured above the unloading platform 252 to insure that the cans remain on the platform 252 as they roll down the platform to their collection point, typically a conveyor belt (not shown). When a can is indexed to station "IV" the can is blown off of vacuum chuck head 145*d* in the same way as was described with reference to FIGS. 1–2.

Figure 9:
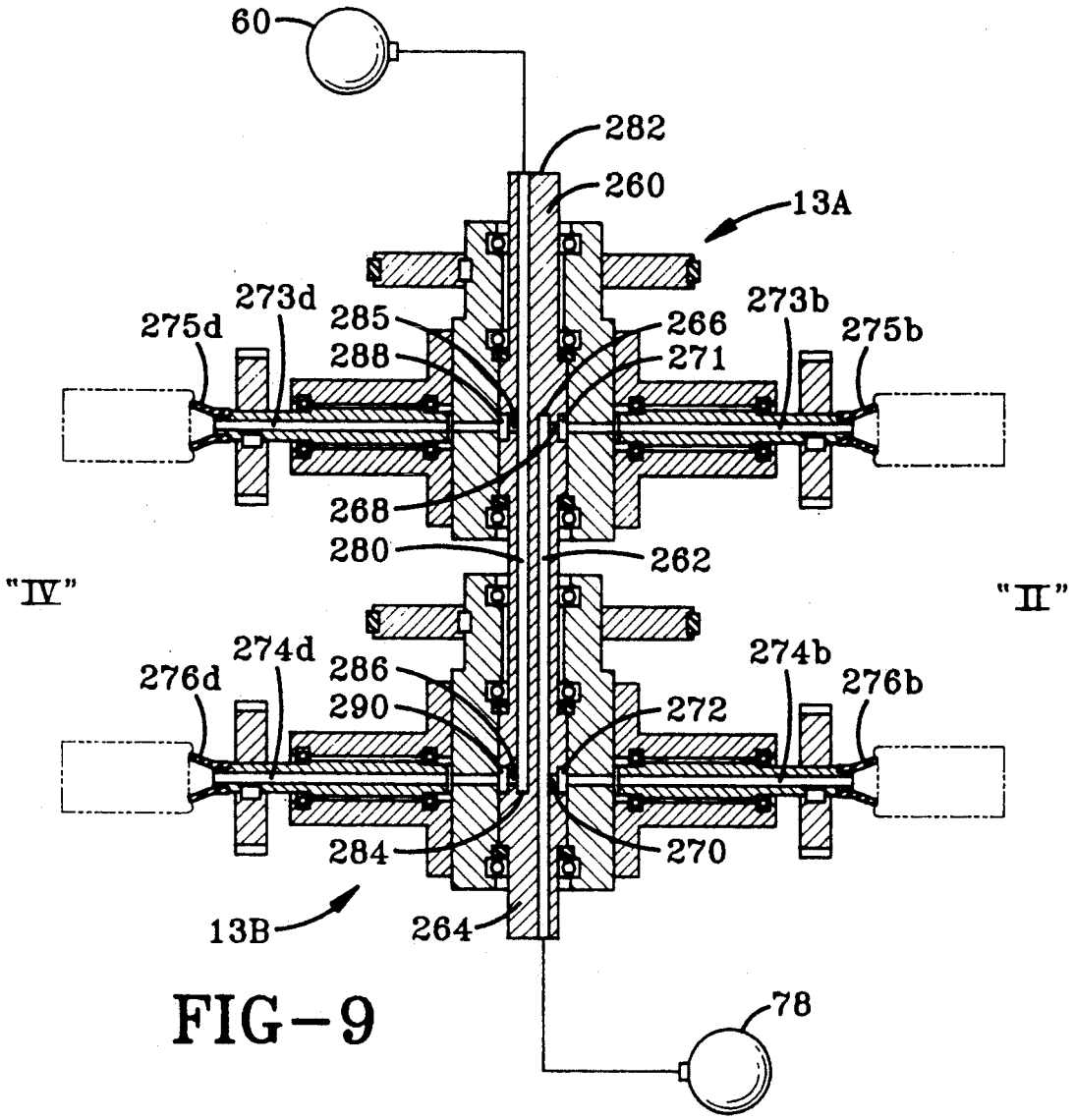
FIG. 9 shows a horizontal indexing machine embodiment of the invention with the turrets stacked vertically.

Having described the loading, coating, curing and unloading of cans and can ends indexed in both the vertical and horizontal planes by means of the can coating system of the present invention. FIG. 9 illustrates another embodiment of an indexing machine of the present invention wherein dual turrets 13A and 13B are vertically stacked for rotation in a horizontal plane. Turrets 13A and 13B are substantially identical to turret 13 of FIGS. 1–2, with the exception of the stationary, central shaft 260 extending therethrough which is a modified version of stationary, central shaft 28. That is, shaft 260 has a first elongated, longitudinal bore 262 opening at the lower end 264 of shaft 260 and extending to an end 266 which is located at approximately the axial center of turret 13A Two passageways, 268 and 270 extend radially outward from bore 262 and connect to grooves 271 and 272, which in turn communicate with bore 273*b* and bore 274*b*, respectively, of the vacuum chucks and vacuum chuck heads 275*b* and 276*b*, respectively, of turrets 13A and 13B when turrets 13A and 13B are at station "II". Likewise, in that turrets 13A, 13B are identical to turret 13, grooves 271 and 272 also communicate with the vacuum chuck heads at stations "I" and "III". As in the embodiment illustrated in FIGS. 1 and 2, the open end of bore 262 is connected to a source 78 of vacuum air pressure.

Shaft 260 has a second elongated, longitudinally extending bore 280 opening at the upper end 222 of shaft 260 and extending to an end 284 which is located at approximately the axial center of turret 13B. Two passageways, 285 and 286 extend radially outward from bore 280 and connect to outlet passageways 288 and 290, respectively, which in turn provide communication through bores 273*d* and 274*d* of the vacuum chucks to vacuum chuckheads 275*d* and 276*d*, respectively, at station "IV". As in the embodiment illustrated in FIGS. 1, 1A and 2, the open end of bore 280 is connected to a source 60 of positive air pressure.

During operation of the embodiment illustrated in FIG. 9, cans are simultaneously vacuumed onto turrets vacuum chuckheads 275*a*, 276*a* from gravity troughs like gravity trough 150 of FIGS. 1–2 which are appropriately positioned at station "I" (not shown). Then, the turrets 13A & 13B index around so that the cans are spray coated at station "II", heat cured at station "III", and finally removed at station "IV" by gravity trough unloaders, of the type illustrated in FIGS. 7 and 8. Alternatively, cans can be loaded at station "I", coated at station "II" and then unloaded at station "III" for transport to a curing oven with the modified shaft of FIG. 10 described above.

While only two turrets are illustrated in FIG. 9, it is within the terms of the invention to dispose additional turrets about a stationary central shaft, of the type illustrated in FIG. 9, but which has been further modified to accommodate the extra turrets. In addition, while the stacked turrets of FIG. 9 are illustrated in a horizontal, indexing machine for rotation about the central shaft through a horizontal plane, alternatively, two or more turrets could be stacked side by side in a vertical, indexing machine of the general type illustrated in FIGS. 1 1A and 2, where the stacked turrets rotate about a stationary, horizontal central shaft through the vertical plane. Moreover, while the FIG. 9 embodiment incorporating a plurality of horizontal or vertical turrets have been generally described for use with cans, it is also within the scope of the invention to employ the can loading and unloading devices of FIGS. 5 and 6 with plural horizontal or vertical turrets rotating about a common fixed shaft for a high volume can lid coating operation requiring only a minimum of floor space Again, in such an embodiment either a shaft like 28 of FIG. 1 could be used in a four station indexing machine which includes curing, or a shaft like 231 of FIG. 10 could be used in a three station indexing machine which loads the lids, coats them, and then unloads them for transport to a curing operation.

As can now be appreciated from the above description, there has been provided in accordance with this invention an apparatus for coating containers such as cans and closures such as can lids on a turret type indexing machine which is configured so that the cans or can lids are supported from the edge of the turret with the turret rotating in either the horizontal or the vertical planes, as well as an apparatus adapted to have a plurality of turrets indexing about a common vertical or horizontal fixed shaft to satisfy the objects and advantages set forth above. The invention not only quickly and easily loads and unloads cans and can lids but uses an economical machine with stacked turrets instead of a separate machine for each turret.

It is apparent that there has been provided in accordance with this invention a coating system for indexing can and can lids through a coating station, and optionally also a curing station, on at least one turret rotating about a stationary shaft in either a vertical or horizontal plane that satisfies the objects, means and advantages set forth hereinabove. While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and scope of the appended claims.

We claim:

1. An indexing machine for a coating system, comprising:

a central, stationary shaft having first and second bores adapted for connection to a source of vacuum air pressure and to a source of positive air pressure, respectively;

at least one turret rotatably disposed about said shaft for indexing therearound, said turret having a plurality of passageways and a plurality of vacuum chucks for supporting a product to be coated, each of said passageways communicating with an internal bore of one of said vacuum chucks, said passageways selectively communicating with said first and second bores as said turret rotates about said shaft.

2. The indexing machine as in claim 1 wherein at least two turrets are disposed about said shaft.

3. The indexing machine as in claim 1 wherein said at least one turret rotates in a horizontal plane.

4. The indexing machine as in claim 1 wherein said at least one turret rotates in a vertical plane.

5. The indexing machine as in claim 1 wherein said vacuum chucks extend radially outward about first and second axes extending perpendicular to a third axis through said shaft for indexing said product about said shaft.

6. The indexing machine as in claim 5 wherein said vacuum chucks rotate about said first and second axes.

7. The indexing machine as in claim 1 wherein said stationary shaft includes a groove disposed about a portion of its circumferential surface, said groove being connected to said first bore, said groove being connected to said passageways of said turret which are open to said groove as said turret rotates about said shaft.

8. The indexing machine as in claim 7 wherein said stationary shaft includes an outlet passageway on its circumferential surface, said outlet passageway being in spaced relationship from one end of said groove, said outlet passageway being connected to said second bore, said outlet passageway being connected to whichever of said passageways of said turret which are open to said outlet passageway as said turret rotates about said shaft.

9. The indexing machine as in claim 7 wherein said vacuum chucks are supported by a turret block at one end, and include a vacuum chuckhead at the other end, said shaft being received within a bore in said turret block, said vacuum chuckhead having an open interior which communicates with said bore in said vacuum chuck, said passageways of said turret being disposed in said turret block.

10. An indexing machine for a coating system for containers or closures having at least one turret with multiple vacuum chucks rotating in a horizontal plane, comprising:

means for loading said containers or closures of said vacuum chucks at a first station of said turret;

means for applying a coating to said containers or closures at a second station of said turret; and means for unloading said containers or closures from said turret.

11. The indexing machine as in claim 10 further comprising means for curing said coating on said containers or closures at a third station of said turret.

12. The indexing machine as in claim 10 wherein said means for unloading said containers or closures from said turret is at a fourth station of said turret.

13. The indexing machine as in claim 10 wherein said means for unloading said containers or closures is located at a third station of said turret.

14. The indexing machine as in claim 10 having at least two turrets with multiple vacuum chucks rotating in a horizontal plane and means for simultaneously loading containers or closures onto said vacuum chucks of said turrets at said first station, means for simultaneously applying coating to containers or closures at said second station, and means for simultaneously unloading containers or closures from said vacuum chucks of said turrets.

* * * * *

UNITED STATES PATENT AND TRADEMARK OFFICE

CERTIFICATE OF CORRECTION

PATENT NO. : 5,254,164

DATED : October 19, 1993

INVENTOR(S) : Matsunaga

It is certified that error appears in the above-indentified patent and that said Letters Patent is hereby corrected as shown below:

On Column 1, Line 25 of the Patent, please replace "post-Repair" with --Post-Repair--.

On Column 1, Line 37 of the Patent, the new sentence at the end of the line beginning with "A" should be starting a new Paragraph.

On Column 2, Line 63 of the Patent, please replace "invention. The" with --invention, the--.

On Column 2, Line 65 of the Patent, please insert a --.-- after "cured".

On Column 3, Line 13 of the Patent, please replace "rotates" with --rotate--.

On Column 3, Line 19 and 47, on Column 8, Line 57, and on Column 9, Line 9 of the Patent, please replace "Vacuum" with --vacuum--.

On Column 3, Line 50, of the Patent,please delete "onto" (1st occur.).

On Column 3, Line 62 of the Patent, please insert a "." after "shaft".

On Column 4, Line 57 of the Patent, replace "as" (2nd occur.) with -(as-.

On Column 4, Line 60 of the Patent, replace "With" with --with--.

UNITED STATES PATENT AND TRADEMARK OFFICE

CERTIFICATE OF CORRECTION

PATENT NO. : 5,254,164
DATED : October 19, 1993
INVENTOR(S) : Matsunaga

It is certified that error appears in the above-indentified patent and that said Letters Patent is hereby corrected as shown below:

On Column 5, Line 41 of the Patent, insert a "." after "44".

On Column 5, Line 43 of the Patent, replace "Which" with --which--.

On Column 5, Line 53 of the Patent, replace "Valve" with --valve--.

On Column 6, Line 5 of the Patent, replace "86a." with --86a,".

On Column 6, Line 6 of the Patent, insert a --.-- after "shaft 28".

On Column 6, Line 22 of the Patent, insert a --.-- after "plate 26".

On Column 7, Line 16 of the Patent, replace "then" with --than--.

On Column 7, Line 23 of the Patent, replace "elements" with --element--.

On Column 7, Line 44 of the Patent, replace "respectively Which" with --respectively, which--.

On Column 7, Line 45 of the Patent, replace "and, accordingly," with --and, accordingly--.

On Column 8, Line 51 of the Patent, replace "station Ill" with --station "III"--.

On Column 9, Line 9 of the Patent, replace "Vacuum" with --vacuum--.

On Column 9, Line 36 of the Patent, replace "trough" with--through--.

On Column 9, line 55 of the Patent, insert a --.-- after "24".

On Column 10, Line 47, of the Patent insert a --.-- after"discussed".

UNITED STATES PATENT AND TRADEMARK OFFICE

CERTIFICATE OF CORRECTION

PATENT NO. : 5,254,164
DATED : October 19, 1993
INVENTOR(S) : Matsunaga

It is certified that error appears in the above-indentified patent and that said Letters Patent is hereby corrected as shown below:

On Column 11, Line 20 of the Patent, replace "invention. FIG" with --invention, FIG--.

On Column 11, Line 31 of the Patent, insert a —.-- after "13A".

On Column 12, Line 20 of the Patent, insert a —.-- after "space".

On Column 14, Line 10 of the Patent, insert --onto one-- after "closures".

Signed and Sealed this

Twentieth Day of June, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,254,164

DATED : October 19, 1993

INVENTOR(S) : Matsunaga

It is certified that error appears in the above-indentified patent and that said Letters Patent is hereby corrected as shown below:

On title page, item [75] "Masahumi" should read —Masafumi—

Signed and Sealed this

Eighth Day of August, 1995

*Attest:*

BRUCE LEHMAN

*Attesting Officer*

*Commissioner of Patents and Trademarks*